United States Patent [19]

Plötz

[11] 4,453,710

[45] Jun. 12, 1984

[54] DUMBBELL

[76] Inventor: Eberhard Plötz, Vinnhorster Weg 43, D-3000 Hannover 21, Fed. Rep. of Germany

[21] Appl. No.: 368,367

[22] Filed: Apr. 14, 1982

[30] Foreign Application Priority Data

Apr. 18, 1981 [DE] Fed. Rep. of Germany ... 8111724[U]

[51] Int. Cl.[3] ..... A63B 11/00

[52] U.S. Cl. ..... 272/122; 403/167

[58] Field of Search ..... 272/123, 122, 124, 143, 272/93; 403/DIG. 4, 167, 168

[56] References Cited

U.S. PATENT DOCUMENTS 4,021,040 5/1977 Inoue ..... 272/123

*Primary Examiner*—Richard J. Apley
*Assistant Examiner*—William R. Browne
*Attorney, Agent, or Firm*—Allegretti, Newitt, Witcoff & McAndrews, Ltd.

[57] ABSTRACT

An exercise dumbbell having wheel weights on each end thereof that are each detachably attached to a grip bar by locking tabs on the grip bar and complementary stops on each wheel weight. The weights are engageable with each other on the grip bar and are locked thereon by rotating each weight relative to the grip bar thereby interlocking the complementary stops with the locking tabs.

4 Claims, 2 Drawing Figures

DUMBBELL

BACKGROUND OF THE INVENTION

1. Field of the Invention

The present invention relates to exercising dumbbells having a grip bar and wheel weights that can be placed interchangeably on the grip bar.

2. Background of the Invention

Dumbbells with interchangeable wheel weights are wellknown in the prior art. One disadvantage common to many of these dumbbells is that changing the number and position of the weights is a cumbersome and time-consuming operation. Since many exercise programs require different weight configurations for different exercises, a dumbbell with easily exchangeable weights would facilitate such exercise programs.

West German Patent Application No. 24 19 221 discloses a dumbbell having a grip bar with radially spaced pipe pieces onto which wheel weights may be placed. The weights are held in place by means of sleeves. The pipe pieces are then fixed in the axial direction by setting rings. However, the construction of this dumbbell is quite complicated and requires numerous manipulations in order to change the weights on the dumbbell.

West German Pat. No. 361 664 discloses a dumbbell whose wheel weights are screwed onto turn sleeves. These turn sleeves are then placed on the grip bar and screwed on tightly by means of a nut. The exchange of wheel weights on this dumbbell is also quite time-consuming and toublesome.

In addition, there is a one-piece dumbbell on the market whose weights may be changed by inserting different weight portions into hollow sections of the wheel weights. The changing of weights on this dumbbell is also quite difficult. Moreover, this dumbbell has uneven weight distribution due to the partial filling of the wheel weights that causes undesirable torque as the dumbbell is used.

Thus, there is a need for an exercise dumbbell whose wheel weights may be exchanged quickly and efficiently.

SUMMARY OF THE INVENTION

It is an object of the present invention to provide a dumbbell having a grip bar and multiple wheel weights such that the wheel weights may be easily and simply interchanged.

Specifically, it is an object of the present invention to provide a dumbbell having a grip bar with a plurality of locking tabs on each end that are engageable with complementary stops formed from the bore walls of the wheel weights. Thus, the wheel weights may be attached to the grip bar by placing the wheel weight over the grip bar and rotating the wheel weight relative to the grip bar thereby interlocking the complementary stops with the locking tabs.

Thus, the present invention provides a dumbbell whereby a plurality of wheel weights may be easily and efficiently interchanged without additional fastening means. This results in a dumbbell that greatly facilitates exercise programs requiring different numbers and configurations of weights.

Further objects and embodiments of the present invention will become evident from the following description of the preferred embodiment and claims.

DESCRIPTION OF THE PREFERRED EMBODIMENT

Figure 1:
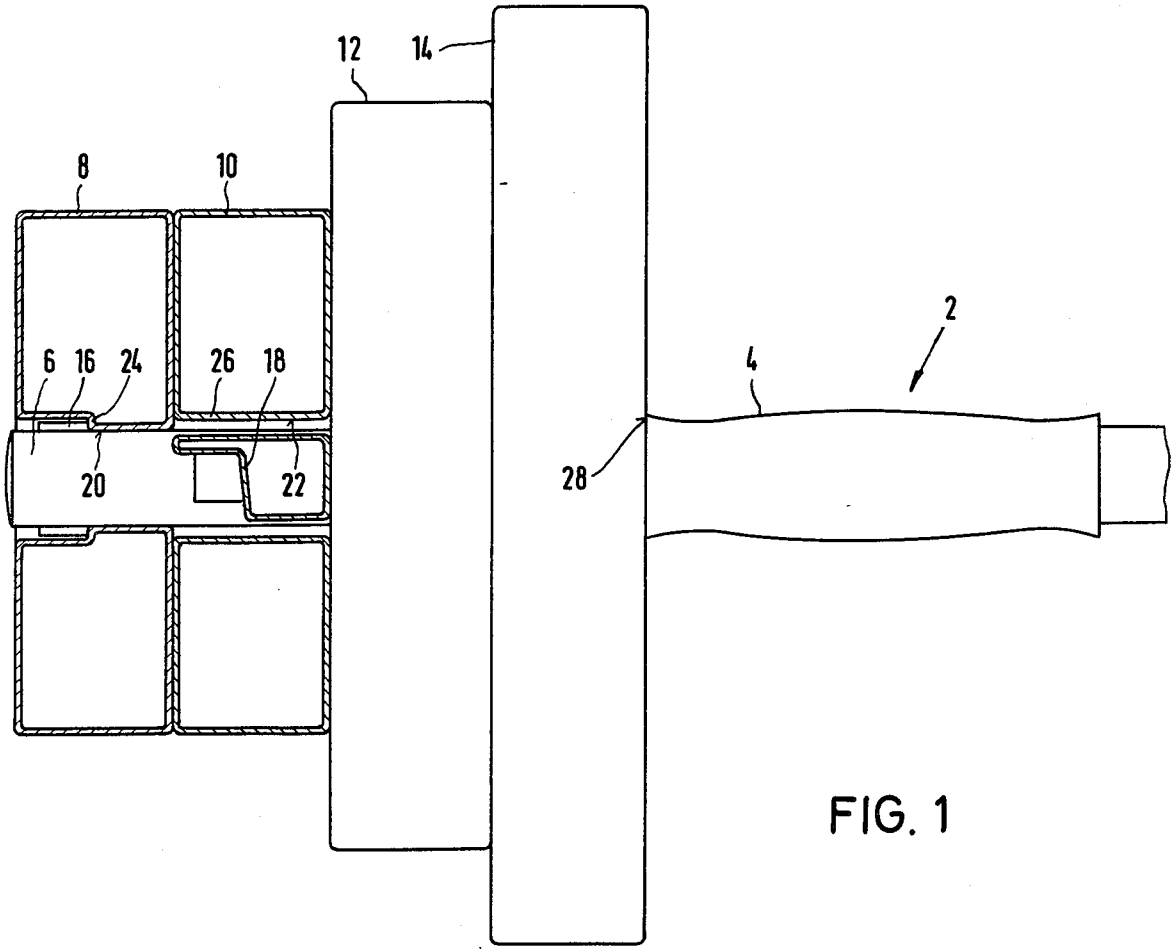
FIG. 1 is a side view, partially cut away, of one half of the improved dumbbell, the other half being substantially identical.
Figure 2:
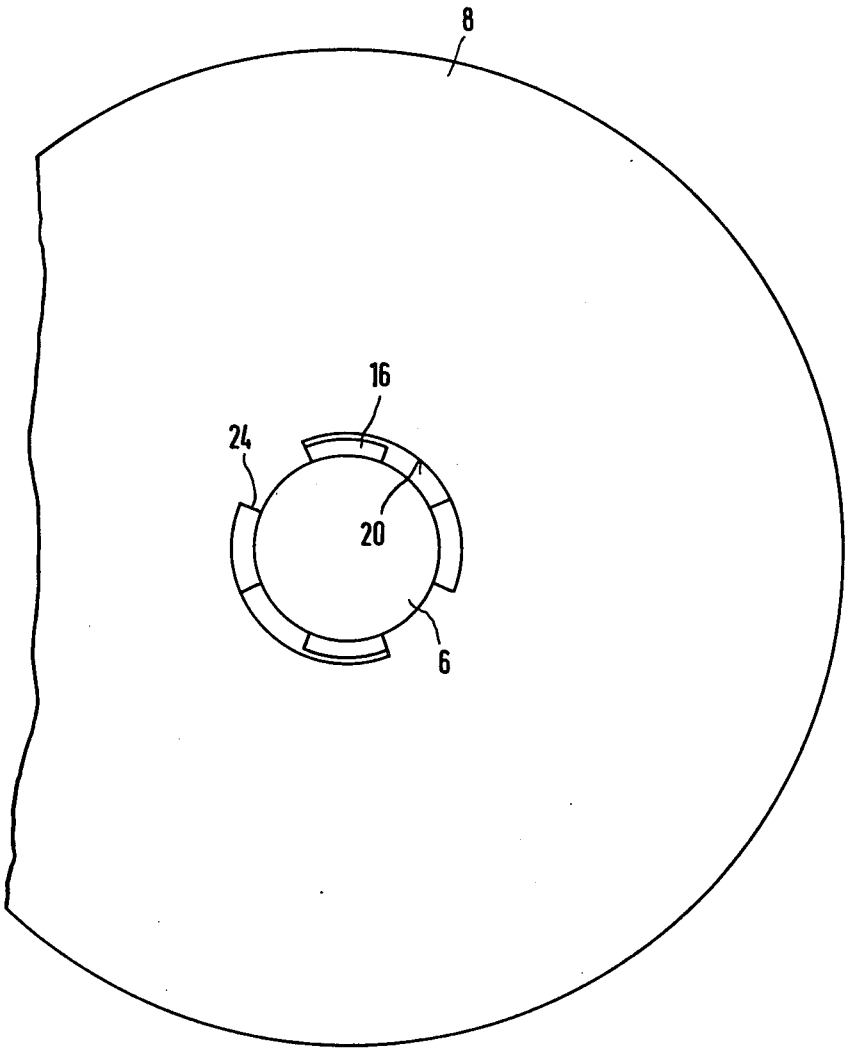
FIG. 2 is a top view of a wheel weight attached to the grip bar according to the present invention.

Referring to FIGS. 1 and 2, the improved dumbbell according to the present invention has a grip bar 2 with a crowned central grip portion 4. The grip bar 2 also has an outer wheel weight part 6 onto which the wheel weights, 8, 10, 12, and 14 may be inerchangeably placed. The outer wheel weight part 6 is provided with a plurality of locking tabs, two of which, 16 and 18, are shown. Each of the wheel weights 8, 10, 12, and 14 have inside bore walls. Only two of these bore walls, 20 and 22, are shown for the wheel weights 8 and 10, respectively. The bore walls for each wheel weight form at least one complementary stop, two of which, 24 and 26, are shown. These complementary stops are engageable with the locking tabs of the outer wheel weight part 6.

When a wheel weight is placed on the outer wheel weight part, the wheel weight's bore wall allows the wheel weight to pass over the locking tabs. Once the wheel weight is in proper position the wheel weight is rotated relative to the grip bar such that the locking tabs engage the apropriate complementary stops and hold the wheel weight firmly in place. The wheel weight may be easily detached from the grip bar by rotating the wheel weight in the opposite direction.

A shoulder 28 is formed by the grip part 4. The shoulder serves as a stop for the innermost wheel weight and prevents it from migrating towards the center of the grip bar. The wheel weights are hollow bodies and may be filled with water, sand, stones, lead shot, or metal parts. The entire dumbbell, with the exception of the wheel weight fillers, is preferably formed of plastic.

It is understood that the above described embodiment of the invention is merely illustrative of applications of the principles of this invention and that numerous other arrangements and modifications may be made within the spirit and scope of this invention.

I claim as my invention:

1. An improved dumbbell having a grip bar with two ends and a plurality of wheel weights mountable at each end thereof, the improvement in combination therewith comprising said grip bar having on each end a plurality of locking tabs, each of said wheel weights having an axial bore, each said axial bore including at least one axially extending channel and at least one complementary stop, said channel extending through the entire axial bore of each said wheel weight to provide an unimpeded passageway for the receipt and passage of said locking tabs such that each said wheel weight can pass over said locking tabs, each of said locking tabs being engageable with at least one of said complementary stops upon rotation of said wheel weight relative to said grip bar.

2. The improved dumbbell of claim 1 wherein four wheel weights are detachably attached to said grip bar on each end of said grip bar.

3. The improved dumbbell of claim 1 wherein said wheel weights have different outside diameters.

4. The improved dumbbell of claim 1 wherein said grip bar further comprises a crowned central grip portion and a wheel weight stop.

* * * * *